United States Patent [19]

Hanford

[11] Patent Number: 5,040,251

[45] Date of Patent: Aug. 20, 1991

[54] METHOD AND APPARATUS FOR MOUNTING OF UPRIGHT POSTS IN SWIMMING POOLS

[75] Inventor: Marvin R. Hanford, Graham, N.C.

[73] Assignee: Hanford Pool & Spa Center, Inc., Burlington, N.C.

[21] Appl. No.: 553,856

[22] Filed: Jul. 6, 1990

[51] Int. Cl.[5] ..... E04H 4/14

[52] U.S. Cl. ..... 4/496; 4/506

[58] Field of Search ..... 4/488, 494, 496, 498, 4/503, 506; 52/297, 298, 169.7, 184; 182/93; 256/1; 248/511, 519, 530

[56] References Cited

U.S. PATENT DOCUMENTS

| | | | |
|---|---|---|---|
| 1,402,561 | 1/1922 | Banks | 52/298 X |
| 1,799,314 | 4/1931 | Pfaff | 52/298 |
| 2,952,024 | 9/1960 | Bartolucci | 4/503 |
| 2,958,872 | 11/1960 | Meyer, Jr. | 4/503 |
| 3,205,634 | 9/1965 | Wagner | 52/298 X |
| 3,744,198 | 7/1973 | Boassy | 52/184 |
| 3,749,424 | 7/1973 | Greene | 4/507 X |
| 3,868,732 | 3/1975 | Englehart | 4/496 |
| 3,895,400 | 7/1975 | Kelcey | 4/494 |
| 4,051,638 | 10/1977 | Heintz | 4/498 X |
| 4,561,134 | 12/1985 | Mathews et al. | 4/496 |
| 4,610,432 | 9/1986 | Lewis et al. | 256/1 X |
| 4,939,037 | 7/1990 | Zion et al. | 52/298 X |

FOREIGN PATENT DOCUMENTS

| | | | |
|---|---|---|---|
| 347721 | 4/1931 | United Kingdom | 4/496 |

*Primary Examiner*—Henry J. Recla
*Assistant Examiner*—Robert M. Fetsuga
*Attorney, Agent, or Firm*—Bell, Seltzer, Park & Gibson

[57] ABSTRACT

A method and apparatus for installing a mounting support for upright supporting posts in pools, particularly of the type having a vinyl liner. A hollow tube having a closed lower end and a coupler collar at the upper end is embedded in the ground defining the bottom of the pool. A top plate and gasket are secured to the coupler collar with the vinyl liner positioned therebetween. An upright post for a swimming pool accessory may then be easily engaged in or disengaged from the mounting support. A pop-on cap may be fitted to the opening of the mounting support when the mounting support is not in use.

9 Claims, 2 Drawing Sheets

METHOD AND APPARATUS FOR MOUNTING OF UPRIGHT POSTS IN SWIMMING POOLS

FIELD OF THE INVENTION

This invention relates to mounting supports for securing swimming pool accessories and, more particularly, to a method and apparatus for mounting an upright supporting post in the bottom of a pool such that a swimming pool accessory, that is most conveniently carried by an upright post, may be readily installed in and removed from a pool.

BACKGROUND OF THE INVENTION

The use and enjoyment of swimming pools, particularly home or "private" pools, has been greatly enhanced by the availability of a myriad of swimming pool accessories. These include stools, tables, games, ladders, cover props, rails for drop-in steps, and rails for walk-in steps, among others. These accessories usually must be mounted in the pool or to the surrounding deck area, often in an upright fashion. The deck area for an above-ground pool is frequently made of wood installed adjacent to the sides of the pool and typically provides a walkway, a sunbathing area, or seating, for pool users. For in-ground pools, this deck area is often formed of concrete. Pool accessories attached to or positioned on the deck may impede these intended uses of the deck area.

One desirable type of accessory is one that may be mounted in the pool rather than on the deck. In-pool mounting provides an additional degree of flexibility in the design and use of pool accessories. It is important, however, that any in-pool mounting arrangement permit the accessory to be easily removed from the pool to facilitate lap swimming and general pool housekeeping. It is also important for user convenience that an in-pool accessory be easy to install. The mounting arrangement, whether in the pool or on the deck area, should provide good lateral stability for the accessory without cluttering the pool or its adjacent deck surface.

Mounting a swimming pool accessory is especially difficult for a pool of the type having a vinyl liner. Penetrating the vinyl liner is typically desirably minimized or avoided, for any resulting openings may lead to leaks if associated fixtures are not properly designed and installed. In addition, designs for vinyl liner fixtures need to take into account that vinyl liners may often be changed as frequently as every five years during the life of a pool. Accordingly, any fixture must be configured such that access to the area behind the liner is not required to secure the new liner to the fixture. For example, U.S. Pat. No. 3,868,732 to Englehart discloses an anchoring device to be secured to the steel wall of a vinyl lined pool such that the vinyl liner may be changed without disrupting the decking or concrete to gain access to the device.

The art has developed several ways to position and install supporting fixtures and accessories for use with vinyl-lined pools without requiring penetration of the vinyl liner. For example, a basketball goal or volleyball net accessory may be positioned on the deck outside the pool by filling a large reservoir at the base of the accessory with water or sand. The filled reservoir provides a degree of stability to the accessory, yet it is inconvenient to move the accessory with the heavy reservoir, or without first emptying the reservoir before moving the accessory.

Tables for use in pools are available that attach to the bottom of the pool with a suction cup device. However, the suction cup anchor may be difficult to engage and disengage and the pool accessory may also lack lateral stability. Pools are often covered, when not in use, to reduce contamination of the water by insects, dirt, and falling leaves. The table with a suction cup anchor may be left in the pool to function as the prop to prevent an overlying pool cover from sagging at its center. In addition to the suction cup table functioning as a cover prop, free floating air-filled "pillows" are known in the art to raise the center portion of a pool cover to form a pyramid that promotes drainage and prevents the unwanted accumulation of dirt or snow on the cover.

The art has also developed handrails for walk-in steps that attach only at the pool deck, yet extend for several feet out over the pool. The handrail is typically a looped metal tube secured at two adjacent positions at the pool deck. This type of handrail, especially at the point farthest from the attaching positions, does not provide a sturdy arrangement for supporting pool users.

Drop-in pool step ladders have been attached at their upper end to the deck and rest, at their lower end, against the sidewall of the liner. Pool users can ascend or descend the steps to use the pool and the drop-in ladder may be removed for pool maintenance. Unfortunately, the area where the lower end of the drop-in ladder contacts the liner is subject to wear caused by movement of the ladder from the weight of swimmers using the ladder.

In concrete pools, many accessories, such as stools and tables, are often permanently mounted or formed in the concrete itself. These permanently mounted or formed-in accessories present impediments to lap swimming and general housekeeping of the pool. These permanently mounted structures also present surfaces upon which algae may grow and which may be difficult to clean. Any mounting support on the deck may cause difficulty when covering a pool and may also cause damage to the pool cover caused by abrasion from the support.

There thus exists a need to provide a mounting support in the bottom of a pool, especially a vinyl-lined pool, that provides a sturdy support for a swimming pool accessory and yet allows the accessory to be easily engaged and disengaged from the mounting support. Easy removal of the pool accessory will facilitate lap swimming and general pool housekeeping. The mounting support should also maintain a water tight seal with the vinyl liner, and yet permit periodic replacement of the vinyl liner.

OBJECT AND SUMMARY OF THE INVENTION

It is therefore an object of the present invention to provide an improved method and apparatus for providing an upright mounting support in a swimming pool of the type having a vinyl liner.

It is a further object of the present invention to provide an improved method and apparatus for providing an upright mounting support in a swimming pool of the type having a concrete floor.

It is still a further object of the present invention to provide a method and apparatus for mounting the post of a swimming pool accessory in the bottom of a swimming pool so that the post can be readily engaged and disengaged from the mounting support to facilitate lap swimming, maintenance, and other activities.

These and other objects are provided according to the present invention by a method and apparatus of installing a mounting support in the bottom of a swimming pool. The mounting support may receive the upright mounting post of a swimming pool accessory such as a stool, table, game, ladder, cover prop, rail for drop-in steps, or rail for walk-in steps, among others. Swimming pool accessories may then be readily engaged in and disengaged from the mounting support, thereby avoiding obstacles and maintenance difficulties presented by permanently affixed or formed in pool accessories. Pool accessories that were previously positioned on the deck area may be placed in the pool by using the mounting support according to the present invention. Therefore, the usable deck area for walking, sunbathing, and sitting is increased.

The mounting support is an upright hollow tube with a closed lower end and a coupler collar mounted on its upper end embedded in an area of the ground defining the bottom of the pool. The closed lower end of the mounting support tube prevents water from draining from the pool. In a preferred embodiment according to the present invention, the mounting support may be embedded in a quantity of concrete to ensure good lateral stability of the mounting support and a swimming pool accessory post positioned therein.

The upper end of the coupler collar is positioned to terminate substantially flush with the bottom of the pool. For a vinyl-lined pool, the vinyl liner is positioned over the embedded upright hollow tube and the ground. A top plate and sealing gasket is fastened to the coupler collar with the vinyl liner positioned therebetween. The vinyl liner exposed within the hole of the top plate is severed and removed to gain access to the interior of the embedded upright hollow tube. The top plate, sealing gasket, and coupler collar form a leak proof fixture penetrating the vinyl liner.

The top plate and sealing gasket may be readily removed and a new vinyl liner installed in the pool without disturbing the mounting support tube and coupler collar embedded in the ground at the bottom of the pool. In addition, since a vinyl liner is periodically changed, the mounting support may be easily retrofited to an existing pool during routine liner replacement.

For the concrete pool mounting support according to the present invention, an upright hollow tube with a closed lower end and a coupler collar is embedded in an area of ground below the floor of the pool. The upper end of the coupler collar is positioned to terminate substantially flush with the top of the finished concrete floor. The concrete floor is poured around the upright hollow tube and coupler collar to provide a mounting support for the reception therein of an upright supporting post for a swimming pool accessory.

A pop-on cap may be fitted to the opening of the mounting support when the mounting support is not in use. The cap prevents the unwanted accumulation of the debris in the tube and prevents injuries to pool users.

The foregoing and other objects, advantages, and features of the invention, and the manner in which the same are accomplished, will become more readily apparent upon consideration of the following detailed description of the invention taken in conjunction with the accompanying drawings, which illustrate preferred and exemplary embodiments, and wherein:

DESCRIPTION OF THE PREFERRED EMBODIMENT

Figure 1:
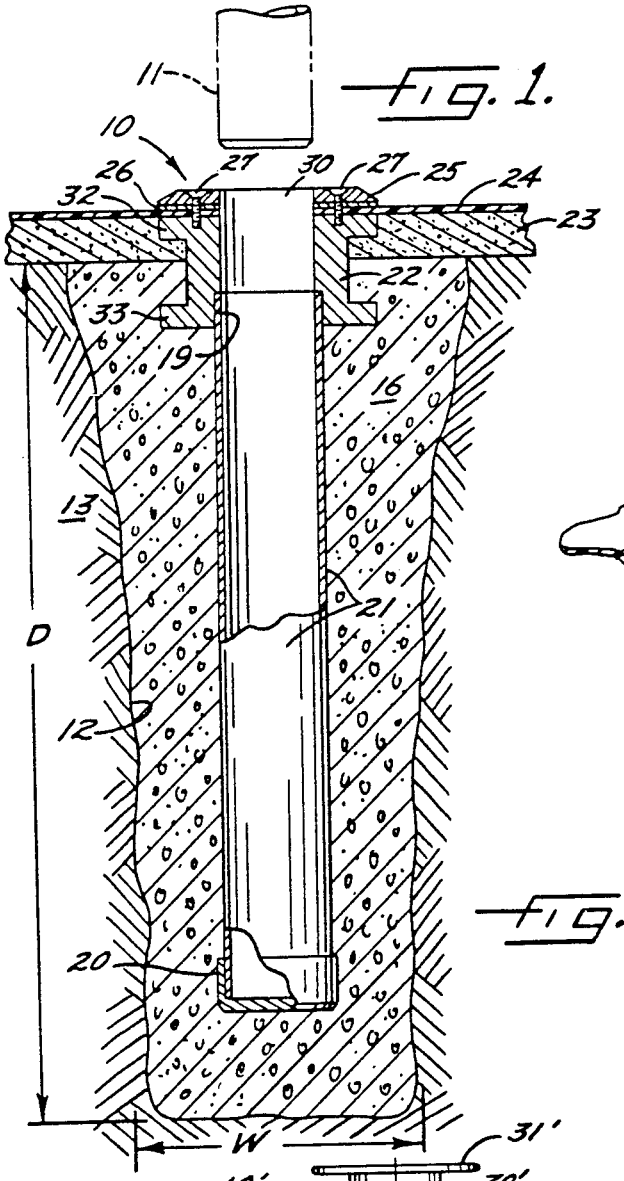
FIG. 1 is a cross-sectional view of an installed mounting support, in a pool of the type having a vinyl liner, according to the present invention.

FIG. 1 illustrates a mounting support 10 for a post 11 of a swimming pool accessory installed, according to the present invention, in a vinyl-lined swimming pool. Any number of swimming pool accessories may be adapted, with the addition of a mounting post or posts 11 to the accessory, for use with the mounting support 10. The post 11 may preferably be a sturdy hollow plastic tube, for example, that would allow water to fill its interior when the post 11 is placed in the pool and yet quickly drain, to reduce the weight of the accessory, when the post 11 is withdrawn from the pool. In other embodiments, it will be understood that other materials may be used for the post 11 and that a solid rather than hollow mounting post 11 may also be provided.

A roughly cylindrical excavation 12 in the undisturbed earth 13 at the bottom of a swimming pool is made to a depth D and width W, for example 24×8 inches respectively, sufficient to hold the mounting support 10 and a surrounding stabilizing material 16 such as concrete. In other embodiments, it will be understood that the depth D and width w of the excavation 12 may be varied and other stabilizing materials 16, such as soil, gravel, or some other aggregate may be used to secure the mounting support 10.

An end cap 20 is secured to the bottom of the hollow tube 21 to provide a resting location for the swimming pool accessory post 11 and to prevent the pool from draining. The hollow tube 21 is secured to the coupler collar 22 by inserting the tube 21 into an annular undercut 19 formed into the lower end of the coupler collar 22. The assembly of the end cap 20, the hollow tube 21, and the coupler collar 22 is positioned in the stabilizing material 16. In a preferred embodiment of the invention, the tube 21 may be formed from a section of polyvinyl chloride (PVC) plastic pipe approximately 12–24 inches in length and approximately 3 inches in inside diameter. The length of the tube 21 provides lateral stability to the post 11 positioned therein.

The coupler collar 22 preferably has an inside diameter, above the undercut 19, that matches the inside diameter of the hollow tube 21 such that a smooth continuous surface is presented to the mounting post 11 along the interior of the overall mounting support 10. In a preferred embodiment of the invention, the inside diameter of the hollow tube 21 and coupler collar 22 is approximately 3 inches. A 3 inch inside diameter permits cleaning of the interior of the mounting support 10 using readily available pool brushes. In other embodiments, where the mounting post has a diameter other than approximately 3 inches, for example when the post 11 is a solid material, it will be understood that the inside diameter of the mounting support 10 may be increased or decreased to accommodate the dimensions of the post 11.

The positioning of the mounting support 10 is such that the top of the coupler collar 22 will lie substantially along the plane defined by the bottom of the swimming pool. After the mounting support 10 is securely positioned, a cover 23 of concrete pool basedaggregate (CPBA, a mixture of vermiculite and cement) is preferably placed in the vicinity of the coupler collar 22 between the ground 23 and the vinyl liner 24 of the pool. The CPBA cover 23 provides a regular and uniform surface upon which the vinyl liner 24 may rest. The vinyl liner 24 is positioned over the coupler collar 22 and a watertight seal is established between the vinyl liner 24 and the mounting support 10 by securing the top plate 25 and a gasket 26 to the coupler collar 22 with the vinyl liner 24 positioned between the coupler collar 22 and the gasket 26. Threaded screws 27, for example, may preferably be used to attach the top plate 25 and coupler collar 22. In other embodiments it will be understood that a welding solvent, a formable gasketing material, or some other sealing arrangement may be used as a substitute for the discrete gasket 26 between the top plate 25 and the vinyl liner 24.

The portion of the vinyl liner 24 exposed in the opening 30 of the mounting support 10 may then be severed and removed such that a post 11 for a swimming pool accessory may be easily inserted into the mounting support 10 and thereby provided with enhanced lateral stability by the length of the hollow tube 21. In a preferred embodiment of the mounting support 10, the cross-section of the opening 30 is circular. In other embodiments, it will be understood that other geometric cross-sections may be used. For example, it will be understood that a square, rectangular, or other cross-sectional geometry may be used to provide enhanced rotational stability of a correspondingly shaped accessory post 11. A locking pin, not shown, passing from a mounting post 11 to the top plate 25 may also be used as an alternative for providing rotational stability of the post 11. A pop-on cover 31 (FIG. 2) may be positioned over the opening 30 of the top plate 25, when a swimming pool accessory post 11 is not installed, to prevent unwanted debris from accumulating in the mounting support 10 and to prevent harm to swimmers and waders.

A post 11 for a swimming pool accessory may be readily engaged by lowering the post 11 into the mounting support 10. Conversely, the post 11 may be easily removed by lifting the post 11 out of the mounting support. The inner surface of the mounting support 10 may then be cleaned, using readily available brushes or pool vacuum accessories. The mounting support 10 provides for easy removal of swimming pool accessories to facilitate general housekeeping of the pool, lap swimming, or other activities where the pool accessory is desirably absent. The mounting support 10 also provides easy installation of swimming pool accessories.

Figure 2:
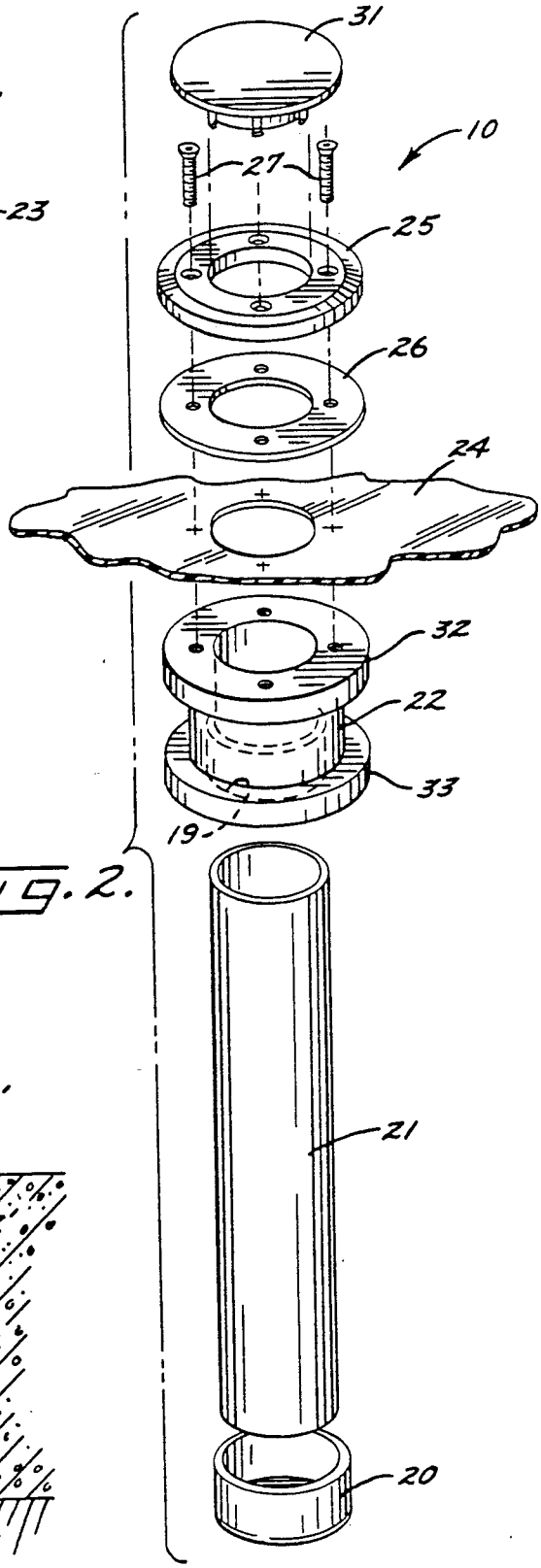
FIG. 2 is an exploded perspective view of the mounting support according to the present invention.

Referring to FIGS. 1 and 2, the main body of the mounting support 10 may preferably be formed from a number of individual plastic pieces, including a coupler collar 22, a hollow tube 21, and an end cap 20. Attachment of the Coupler collar 15 to the hollow tube 20 and attachment of the hollow tube 21 to the end cap 20 may preferably be made by a welding solvent applied to the joints between the pieces, or by threaded joints. The hollow tube 21 and coupler collar 22 are preferably sized such that the exterior diameter of the hollow tube 21 matches with the inside diameter of the annular undercut 19 formed in the lower end of the coupler collar 22 and the inside diameter of the coupler collar 22 and hollow tube 21 match in order to provide a smooth continuous surface for the reception of the mounting post 11. In other embodiments it will understood that any combination of or all of the assembly of the coupler collar 22, the hollow tube 21, and the end cap 20 may be made out of molded plastic or other suitable material.

The coupler collar 22 is preferably cylindrical in shape overlying the hollow tube 21 in a concentric fashion. The coupler collar 22 may be formed with an annular shaped upper flange 32 and lower flange 33. The upper flange 32 provides a surface to which the top plate 25 may be secured to form a watertight seal with the vinyl liner 24. The lower flange 33 provides a mechanical locking means with the stabilizing material 16 for preventing the mounting support 10 from being withdrawn from the bottom of the pool when a swimming pool accessory post 11 is lifted to remove the accessory. The lower inside portion of the coupler collar 22 includes a undercut 19 therein for receipt of the hollow tube 21.

Figure 3:
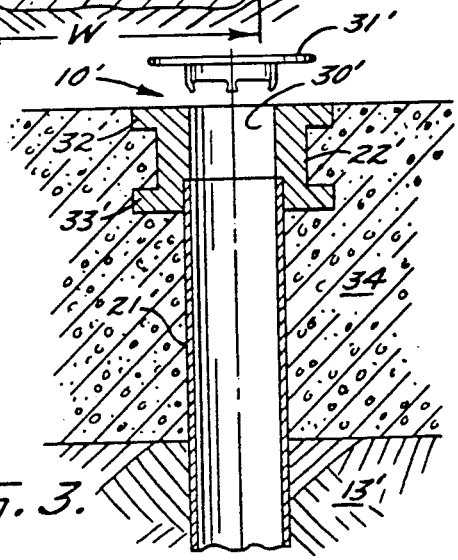
FIG. 3 is a cross-sectional view of an installed mounting support, in a pool of the type having a concrete floor, according to the present invention.

FIG. 3 illustrates another embodiment of the mounting support 10' according to the present invention and adapted to be used in concrete pools. The coupler collar 22', hollow tube 21', and end cap 20' are assembled and positioned in the ground 13' at the bottom of the pool such that the coupler collar 22' will finish flush with the concrete floor 34. The lower portion of the coupler collar 22' includes a undercut 19' therein to receive the upper end of the hollow tube 21'. The concrete 34, typically 8 to 12 inches in thickness, is then poured and troweled to the outer edge of the coupler collar 22'. A pop-on cap 31' may be used to cover the opening 30' of the mounting support 10' whenever desired.

Figure 4:
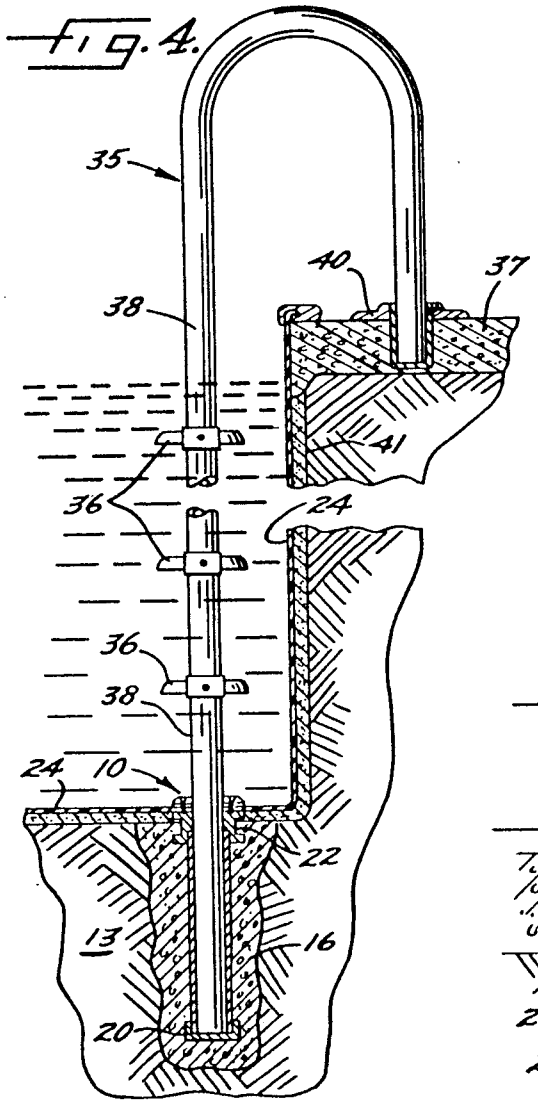
FIG. 4 is a cross-sectional view of the mounting support according to the present invention and showing the upright mounting posts of a removable pool ladder installed therein.

FIG. 4 is an illustration of the mounting support 10 of the present invention adapted for use with a drop-in step ladder 35 for a vinyl-lined pool. The mounting support 10 is secured in a surrounding volume of concrete 16 in the ground 13 below the bottom of the pool. A side rail 38 of the ladder 35 may serve as the vertical mounting post to be received by the mounting support 10. Horizontal steps 36 may be positioned at selected intervals between the rails 38 to form the ladder 35. The rails 38 may be extended above the concrete deck 37 of the pool and curved back to rest upon or be secured to the pool deck 37 in deck supports 40. The mounting support 10 according to the present invention, thereby overcomes the wear on the vinyl liner 24 caused by ladders of the prior art wherein the lower end of the ladder rested against the liner 24 along the sidewall 41 of the pool.

Figure 5:
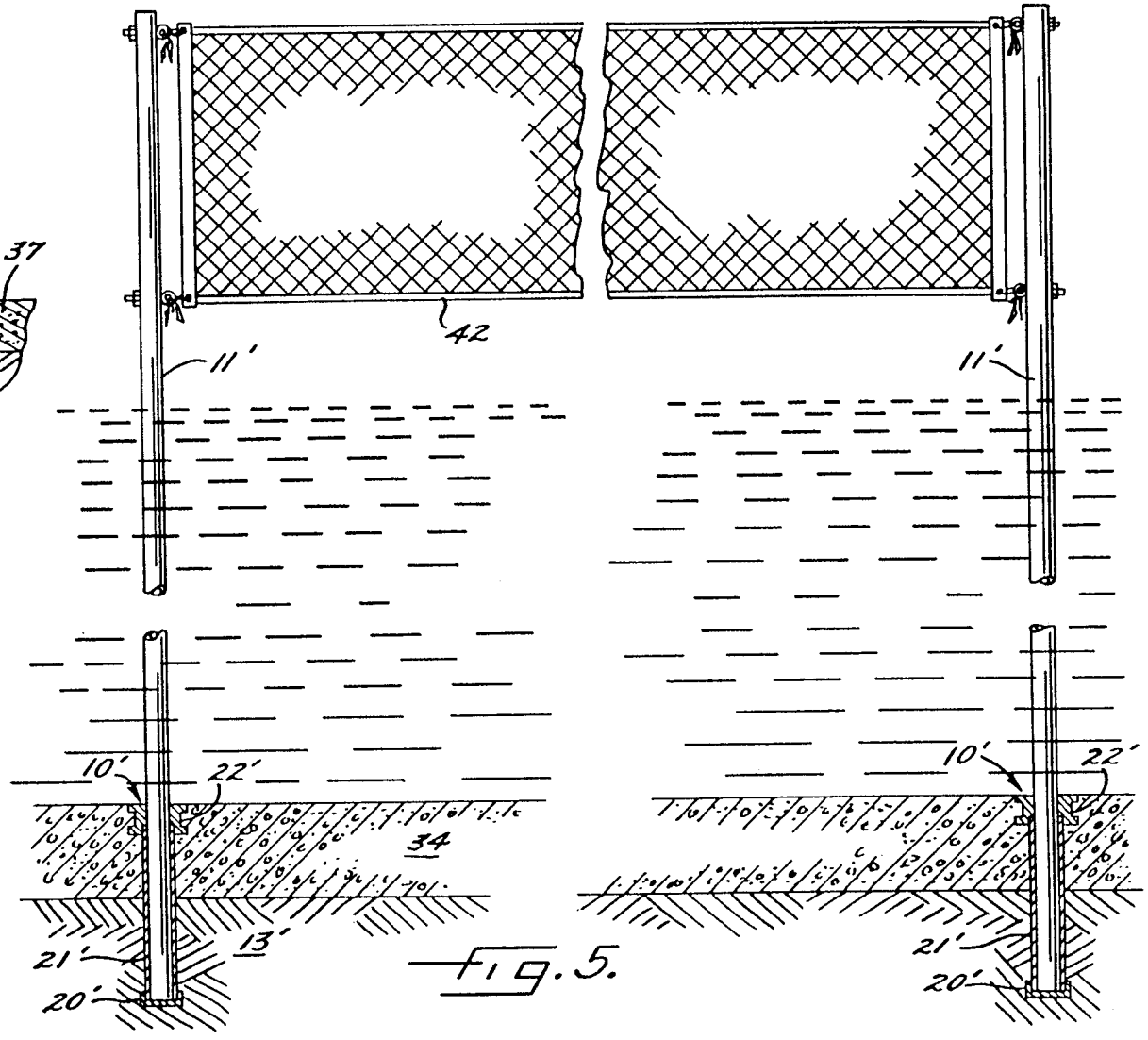
FIG. 5 is a cross-sectional view of the mounting support according to the present invention and showing the upright mounting posts of a volleyball net installed therein.

FIG. 5 is an illustration, according to the present invention, of the mounting support 10' adapted for use in a concrete swimming pool and used in conjunction with mounting posts 11' for a swimming pool volleyball net 42. The mounting supports 10' are embedded in the ground 13' so that the concrete pool floor 34 finishes at the top of the coupler collar 22'. The posts 11' may be manually inserted into the mounting supports 10' and held in place against the end-caps 20' by the downward pull of gravity. The posts 11' are restricted from excessive motion in the lateral direction by the length of the hollow tubes 21' of the mounting supports 10'. The mounting support 10' according to the present invention, thereby provides lateral stability for pool accessories, allows quick removal and installation of accessories, and overcomes the bulky and inconvenient reservoirs used as a mounting arrangement for some prior art pool accessories. It will be understood to adapt many other swimming pool accessories with vertical mounting posts including, for example, stools, tables, other games, ladders, and cover props among others to be used according to the present invention.

In the drawings and specification, there have been disclosed typical preferred embodiments of the invention and, although specific terms have been employed, they have been used in a generic and descriptive sense only and not for purposes of limitation, the scope of the invention being set forth in the following claims.

That which is claimed is:

1. A method of installing a mounting support for reception of an upright supporting post of a swimming pool accessory in a swimming pool of the type having a vinyl liner, said method comprising embedding an upright hollow tube with a closed lower end and a coupler collar mounted on its upper end in an area of the ground defining the bottom of the pool with the upper end of the coupler collar positioned to terminate substantially flush with the bottom of the pool, positioning a vinyl liner over the embedded upright hollow tube and the ground defining the bottom of the pool, fastening a top plate with a sealing gasket to the coupler collar with the vinyl liner positioned therebetween so as to provide a watertight seal with the vinyl liner and wherein the top plate is provided with a hole therethrough of about the same size as the inner diameter of the upright embedded tube, and severing and removing the vinyl liner exposed within the hole in the top plate to gain access to the interior of the embedded upright hollow tube for thereby providing a mounting support for reception therein of an upright supporting post for a swimming pool accessory.

2. A method of installing a mounting support for reception of an upright supporting post for a swimming pool accessory in a swimming pool of the type having a concrete floor, said method comprising embedding an upright hollow tube with a closed lower end and a coupler collar in an area of ground below the floor with the upper end of the coupler collar positioned to terminate substantially flush with the top of the finished concrete floor, and pouring the concrete floor around the upright hollow tube and coupler collar to thereby provide a mounting support for reception therein of an upright supporting post for a swimming pool accessory.

3. A method of installing an upright supporting post for a swimming pool accessory in the bottom of a swimming pool, said method comprising embedding an upright hollow tube with a closed lower end and a coupler collar mounted on its upper end in an area of the ground defining the bottom of the pool with the upper end of the coupler collar positioned to terminate substantially flush with the finished bottom of the pool and positioning a supporting post for a swimming pool accessory in the upright embedded tube.

4. A method of installing an upright supporting post for a swimming pool accessory in a swimming pool of the type having a vinyl liner, said method comprising embedding an upright hollow tube with a closed lower end and a coupler collar mounted on its upper end in an area of the ground defining the bottom of the pool with the upper end of the coupler collar positioned to terminate substantially flush with the bottom of the pool, positioning a vinyl liner over the embedded upright hollow tube and the ground defining the bottom of the pool, fastening a top plate with a sealing gasket to the coupler collar with the vinyl liner positioned therebetween so as to provide a watertight seal with the vinyl liner and wherein the top plate is provided with a hole therethrough of about the same size as the inner diameter of the upright embedded tube, severing and removing the vinyl liner exposed within the hole in the top plate to gain access to the interior of the upright hollow tube, and positioning a supporting post for a swimming pool accessory in the upright embedded tube for thereby being supported by the embedded tube.

5. A method of installing an upright supporting post in a swimming pool of the type having a concrete floor, said method comprising embedding an upright hollow tube with a closed lower end and a coupler collar in an area of ground below the floor with the upper end of the coupler collar positioned to terminate substantially flush with the top of the finished concrete floor, pouring the concrete floor around the upright hollow tube and coupler collar, and positioning a supporting post for a swimming pool accessory in the upright embedded tube for thereby being supported by the embedded tube.

6. A mounting support for reception of an upright supporting post for a swimming pool accessory in a swimming pool of the type having a vinyl liner, said mounting support comprising:

a hollow tube of at least about a foot in length;

an end cap closing one end of said tube and adapted to serve as a closed lower end of the tube;

a coupler collar mounted on the opposite end of said tube adapted to serve as the upper end of the tube, said coupler collar having upper and lower flanges, said lower flange adapted to be embedded with said tube when installed for aiding in anchoring the tube in ground at the bottom of a swimming pool;

a top plate and gasket overlying said upper flange and adapted for securing a vinyl liner between said gasket and said upper flange; and fastener means penetrating said top plate and gasket and adjacent portions of said coupler collar for connecting said top plate to said coupler collar in sealed relation with a vinyl liner therebetween.

7. A mounting support according to claim 6 wherein an annular undercut is provided internally of said coupler collar in the lower portion thereof for reception of the upper end of said hollow tube.

8. In combination with a swimming pool of the type having a vinyl liner, a mounting support in the pool for reception of an upright supporting post for a swimming pool accessory, said mounting support comprising an upright hollow tube with a closed lower end embedded in an area of the ground below said vinyl liner defining the bottom of the pool, a coupler collar mounted on the upper end of said embedded upright tube with the upper end of the coupler collar positioned to terminate substantially flush with the bottom of the pool and in engagement with the underside of said vinyl liner, a gasket overlying said vinyl liner above said coupler collar, a top plate overlying said gasket, said top plate having a hole therethrough of about the same size as the inner diameter of said embedded tube, and fastener means penetrating said top plate and adjacent portions of said underlying coupler collar and said gasket for providing a water tight seal with said vinyl liner whereby the portions of the vinyl liner exposed within the hole of the top plate may be severed and removed to thereby provide a mounting support for reception of an upright supporting post for a swimming pool accessory.

9. In combination with a swimming pool of the type having a concrete floor, a mounting support in the pool for reception of an upright supporting post for a swimming pool accessory, said mounting support comprising an upright hollow tube with a closed lower end embedded in the concrete floor defining the bottom of the pool, and a coupler collar mounted on the upper end of said embedded upright tube with the upper end of the coupler collar positioned to terminate substantially flush with the finished bottom of the concrete floor of the pool to thereby provide a mounting support for reception of an upright supporting post for a swimming pool accessory.

* * * * *